US009528316B1

(12) United States Patent
Strickland et al.

(10) Patent No.: US 9,528,316 B1
(45) Date of Patent: Dec. 27, 2016

(54) IMPACT RESISTANT WINDOW ASSEMBLY FOR TORNADO DOOR

(71) Applicant: Assa Abloy Door Group, LLC, New Haven, CT (US)

(72) Inventors: Bobby Neal Strickland, Trenton, TN (US); John Wilkinson, Big Sandy, TN (US); Billy Kirk, Bradford, TN (US); Charles Stewart, Milan, TN (US); Jeff Badgett, Milan, TN (US)

(73) Assignee: AADG, INC., Milan, TN (US)

( * ) Notice: Subject to any disclaimer, the term of this patent is extended or adjusted under 35 U.S.C. 154(b) by 0 days.

(21) Appl. No.: 14/815,341

(22) Filed: Jul. 31, 2015

Related U.S. Application Data

(60) Provisional application No. 62/048,305, filed on Sep. 10, 2014.

(51) Int. Cl.

| | |
|---|---|
| ***E06B 5/12*** | (2006.01) |
| ***E06B 5/00*** | (2006.01) |
| ***E06B 5/10*** | (2006.01) |
| ***E06B 7/00*** | (2006.01) |
| ***E06B 7/28*** | (2006.01) |
| ***E06B 9/01*** | (2006.01) |
| ***E06B 7/16*** | (2006.01) |
| *E06B 9/00* | (2006.01) |

(52) U.S. Cl.
CPC ..... *E06B 5/12* (2013.01); *E06B 5/003* (2013.01); *E06B 5/106* (2013.01); *E06B 7/00* (2013.01); *E06B 7/16* (2013.01); *E06B 7/28* (2013.01); *E06B 9/01* (2013.01); *E06B 2009/005* (2013.01); *E06B 2009/015* (2013.01)

(58) Field of Classification Search
CPC ..... E06B 5/003; E06B 5/12; E06B 5/106; E06B 7/00; E06B 7/16; E06B 5/5892
USPC ..... 52/202, 203, 208, 455, 204.591, 304.595,52/204.71, 204.72
See application file for complete search history.

(56) References Cited

U.S. PATENT DOCUMENTS 3,641,721 A * 2/1972 Martin ..... E06B 3/685 52/212
3,750,358 A * 8/1973 Lewkowitz ..... E06B 3/5892 52/204.597
4,897,975 A * 2/1990 Artwick ..... E06B 3/5892 52/208

(Continued)

*Primary Examiner* — Beth Stephan
(74) *Attorney, Agent, or Firm* — DeLio, Peterson & Curcio, LLC; David R. Pegnataro

(57) ABSTRACT

A tornado door comprises a door body having spaced first and second exterior panels and a window panel sized to be oriented within an opening in the door body exterior panels. The door includes a plurality of S-shaped stiffeners spacing the interior sides of the door body first and second exterior panels and positioned about the periphery of the window panel forming a frame. A sealant establishes a seal between the window panel and the plurality of S-shaped stiffeners and between the window panel and the door body first or second exterior panel. The door further includes a cover ring placed on an exterior surface of one of the door body first or second exterior panels and juxtaposed with the plurality of S-shaped stiffeners. The cover ring and plurality of S-shaped stiffeners are intersecured using a plurality of fasteners which pass between the cover ring mounting holes through the door body first or second exterior panel and into the stiffener mounting holes.

23 Claims, 8 Drawing Sheets

(56) References Cited

U.S. PATENT DOCUMENTS

| | | | | |
|---|---|---|---|---|
| 5,018,330 | A * | 5/1991 | Lewkowitz | E06B 3/5892 52/455 |
| 5,207,044 | A * | 5/1993 | LaSee | E06B 3/5892 49/171 |
| 5,636,484 | A | 6/1997 | DeBlock | |
| 5,765,325 | A | 6/1998 | DeBlock | |
| 6,318,037 | B1 | 11/2001 | Hansen | |
| 6,546,682 | B1 | 4/2003 | DeBlock et al. | |
| 6,715,245 | B2 * | 4/2004 | Lewkowitz | E06B 7/30 52/204.53 |
| 7,721,501 | B2 * | 5/2010 | Lynch | E06B 3/5892 52/309.9 |
| 8,156,699 | B2 * | 4/2012 | LaSee | E06B 3/5892 52/204.62 |
| 8,359,796 | B1 * | 1/2013 | Plummer | E06B 3/5892 52/204.61 |
| 2003/0066256 | A1 * | 4/2003 | DeBlock | B32B 17/10 52/208 |
| 2004/0016189 | A1 * | 1/2004 | Berger, Jr. | E06B 3/5892 52/208 |
| 2006/0198124 | A1 | 9/2006 | Copland | |
| 2007/0193140 | A1 | 8/2007 | Carnick et al. | |
| 2008/0245003 | A1 | 10/2008 | Kon et al. | |
| 2010/0229500 | A1 * | 9/2010 | Lynch | E06B 3/5892 52/784.13 |

* cited by examiner

IMPACT RESISTANT WINDOW ASSEMBLY FOR TORNADO DOOR

RELATED APPLICATIONS

This application claims priority to U.S. Provisional Patent Application Ser. No. 62/048,305 filed on Sep. 10, 2014.

BACKGROUND OF THE INVENTION

1. Field of the Invention

The present invention relates to doors including a window lite assembly and in particular, to doors including a window lite assembly which are capable of withstanding impact conditions associated with tornado-induced flying debris.

2. Description of Related Art

Federal Emergency Management Agency (FEMA) 320 and 361 set forth design and construction criteria for tornado and hurricane shelters or safe rooms and these standards were designed, in part, to ensure that the door assembly of a shelter or safe room will withstand the impact conditions associated with tornado-induced flying debris. Historically, tornado doors have not included windows or door lite assemblies, and currently available door lite assemblies present various assembly and performance issues and/or do not meet the current FEMA 320 and 361 criteria. Further, many existing door lites are relatively expensive and/or difficult to manufacture and install. As a result, currently available door lite assemblies are not suitable for use in a tornado door. Therefore, the need exists for a tornado door assembly with a vision lite so that any person in a tornado shelter or safe room can see what conditions exist on the other side of the door, where the door lite assembly passes the current FEMA 320 and 361 testing criteria and is relatively easy to manufacture and install.

SUMMARY OF THE INVENTION

Bearing in mind the problems and deficiencies of the prior art, it is therefore an object of the present invention to provide a door including a window lite assembly having improved impact resistance.

It is another object of the present invention to provide an improved door with a window lite assembly, which can withstand impact conditions associated with tornado-induced flying debris.

It is yet another object of the present invention to provide an improved door with a window lite assembly which passes current FEMA 320 and 361 testing criteria.

Still other objects and advantages of the invention will in part be obvious and will in part be apparent from the specification.

The above and other objects, which will be apparent to those skilled in the art, are achieved in the present invention which is directed to an impact resistant window assembly for a tornado door, comprising a window panel sized to be oriented within an opening in a door having spaced first and second exterior panels, the window panel having opposite first and second surfaces and an edge defining a periphery. A plurality of S-shaped stiffeners are positioned about the periphery of the window panel forming a frame. The S-shaped stiffeners space the interior sides of the door first and second exterior panels and define a plurality of mounting holes. The window assembly further includes a cover ring having an aperture and defining a plurality of mounting holes. The cover ring is placed on an exterior surface of one of the door first or second exterior panels and juxtaposed with the plurality of S-shaped stiffeners. The cover ring and plurality of S-shaped stiffeners are intersecured using a plurality of fasteners which pass between the cover ring mounting holes through the door first or second exterior panel and into the S-shaped stiffener mounting holes. A sealant establishes a seal between the window panel and the plurality of S-shaped stiffeners and between the window panel and the door first or second exterior panel.

The window panel, S-shaped stiffeners, cover ring and sealant may establish a structure capable of withstanding the impact conditions associated with tornado-induced flying debris as measured by successful passing of FEMA testing standard FEMA 320 and 361 based on direct impact of a 15 lb. 2×4 board missile traveling at 100 miles per hour.

Each of the S-shaped stiffeners may have a first leg contacting the periphery of the window panel and spacing the interior sides of the door first and second exterior panels, a receiving flange extending from an end of the first leg facing the window panel first surface and extending inward toward the center of the window panel by a predetermined distance, and a mounting flange extending from an opposite end of the first leg, the mounting flange including the stiffener plurality of mounting holes. A plurality of spacers may be transposed between the window panel first surface and the stiffener receiving flanges about the periphery of the window panel.

Each of the stiffeners may have a second leg opposite the first leg and spacing the interior sides of the door first and second exterior panels and including a support flange in the same plane as the stiffener receiving flange. The door may include an inner door liner and the plurality of S-shaped stiffeners may be bonded to the inner door liner.

The window panel may be a laminated glass panel known as Tor-Gard NBR2™, and the sealant may be Dow Corning 955 Adhesive Sealant™. The fasteners may be sheet metal screws.

In another aspect, the present invention is directed to a tornado door comprising a door body having spaced first and second exterior panels with an opening therethrough, the door body further having a length, and a window panel sized to be oriented within the door body opening, the window panel having opposite first and second surfaces and an edge defining a periphery. A plurality of S-shaped stiffeners are positioned about the periphery of the window panel forming a frame. The plurality of S-shaped stiffeners space the interior sides of the door body first and second exterior panels and define a plurality of mounting holes. A cover ring having an aperture and defining a plurality of mounting holes is positioned on an exterior surface of one of the door body first or second exterior panels and juxtaposed with the plurality of S-shaped stiffeners. The cover ring and plurality of S-shaped stiffeners are intersecured using a plurality of fasteners which pass between the cover ring mounting holes through the door body first or second exterior panel and into the stiffener mounting holes. A sealant establishes a seal between the window panel and the plurality of S-shaped stiffeners and between the window panel and the door body first or second exterior panel.

The window panel, S-shaped stiffeners, cover ring and sealant may establish a structure capable of withstanding the impact conditions associated with tornado-induced flying debris as measured by successful passing of FEMA testing standard FEMA 320 and 361 based on direct impact of a 15 lb. 2×4 board missile traveling at 100 miles per hour.

The door body first and second exterior panels may be comprised of gauge steel, and the tornado door may further comprise a polystyrene layer between the door body first and second exterior panels. The tornado door may include S-shaped stiffeners positioned horizontally above and below the window panel and the door may further comprise a plurality of structural stiffeners extending vertically within substantially the entire length of the door body above and below the S-shaped stiffeners and window panel, and spacing the door body first and second exterior panels. The tornado door may further comprise an inner door liner and the plurality of S-shaped stiffeners may be bonded to the inner door liner.

Each of the S-shaped stiffeners may have a first leg contacting the periphery of the window panel and spacing the interior sides of the door first and second exterior panels, a receiving flange extending from an end of the first leg facing the window panel first surface and extending inward toward the center of the window panel by a predetermined distance, and a mounting flange extending from an opposite end of the first leg and including the stiffener plurality of mounting holes. A plurality of spacers may be transposed between the window panel first surface and the stiffener receiving flanges about the periphery of the window panel.

Each of the S-shaped stiffeners may have a second leg opposite the first leg and spacing the interior sides of the door first and second exterior panels, and including a support flange in the same plane as the stiffener receiving flange.

The window panel may be a laminated glass panel known as Tor-Gard NBR2™, and the sealant may be Dow Corning 955 Adhesive Sealant™. The fasteners may be sheet metal screws.

In a further aspect, the present invention is directed to a method of using a tornado door comprising providing the tornado door as described above, exposing the tornado door to impact conditions associated with tornado-induced flying debris and causing the door to bow toward a non-impact side of the door as a result of impact at an impact side of the door. The method may include using the door body, S-shaped stiffeners, cover ring and sealant to maintain the window panel in a secured position between the interior side of the door body first or second exterior panel and the plurality of S-shaped stiffeners as the door bows. The impact conditions associated with tornado-induced flying debris may be measured by FEMA testing standard FEMA 320 and 361.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1-10 of the drawings in which like numerals refer to like features of the invention.

Figure 1A:
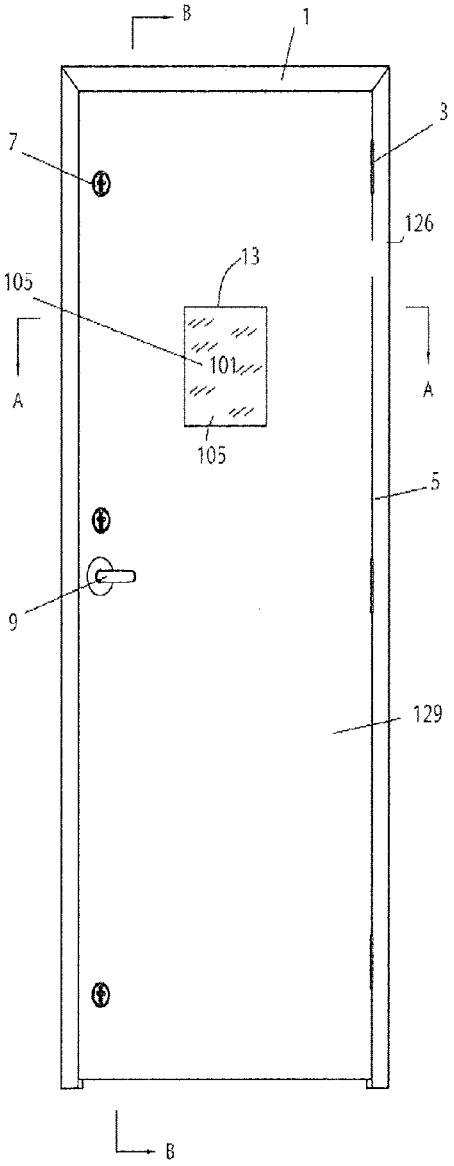
FIG. 1A is a plan view of one embodiment of the tornado door of the present invention from the non-impact side of the tornado door.
Figure 1B:
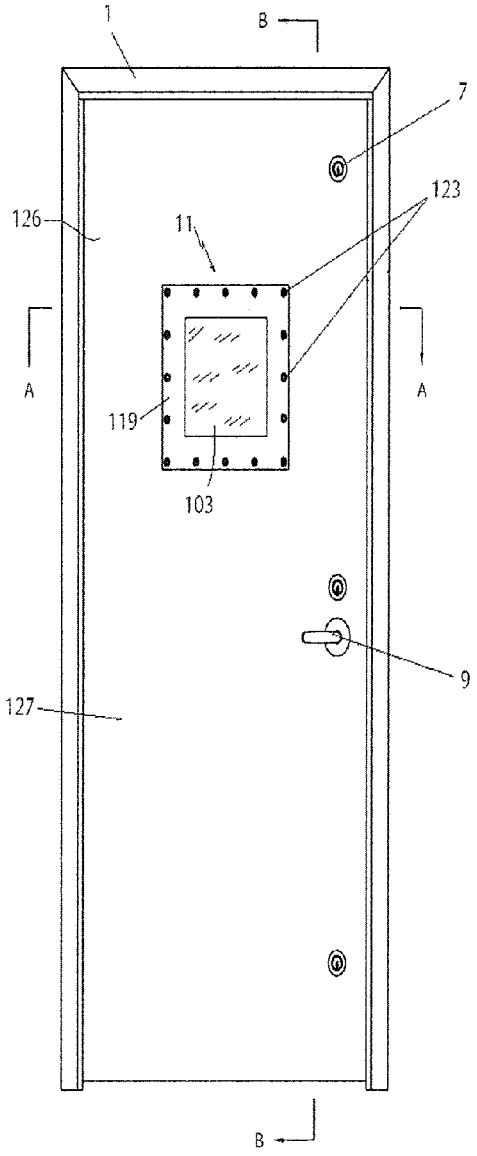
FIG. 1B is a plan view from the impact side of the tornado door of FIG. 1A.

In referring to tornado doors such as shown in the impact side and non-impact side plan views of FIGS. 1A and 1B, a tornado door 126 is a door which is typically found in a tornado shelter or safe room. A tornado door 126 is normally an active door which is opened and closed and is positioned within a door frame 1, and attached to the door frame by a plurality of hinges 3 on one edge 5 of the door. The opposite free edge of the door may include one or more locks 7, such as a deadbolt or cylindrical lock, disposed within the interior of the door for securing the door in a closed position, and a handle 9 for opening and releasing the door when the lock(s) are collectively in an unlocked position. Tornado door 126 includes a door shell having a first exterior panel or outer door skin 127 on the impact side of the door and a second exterior panel or inner door skin 129 on the non-impact side of the door. As shown in FIGS. 1A and 1B, the tornado door may include an opening 13 for receiving a window assembly, such as the impact resistant window assembly 11 of the present invention. The impact resistant window assembly 11 is interposed in the interior portion of the tornado door spacing the inner door skin 129 and the outer door skin 127 and includes internal structural reinforcements which are integral with the door structure. The window assembly further comprises a cover ring 119 secured on an exterior surface of a door skin and juxtaposed over a window panel 101. The cover ring includes an aperture allowing for visibility of exterior conditions by anyone inside the tornado shelter or safe room. As shown in FIG. 1B, the cover ring is secured on the impact side of the tornado door, but alternatively, may instead be secured on the non-impact, interior side of the door. The cover ring is secured using fasteners 123 driven through a plurality of mounting holes (not shown) in the cover ring, through the door skin and into internal structural reinforcements within the door, discussed in more detail below.

Figure 2B:
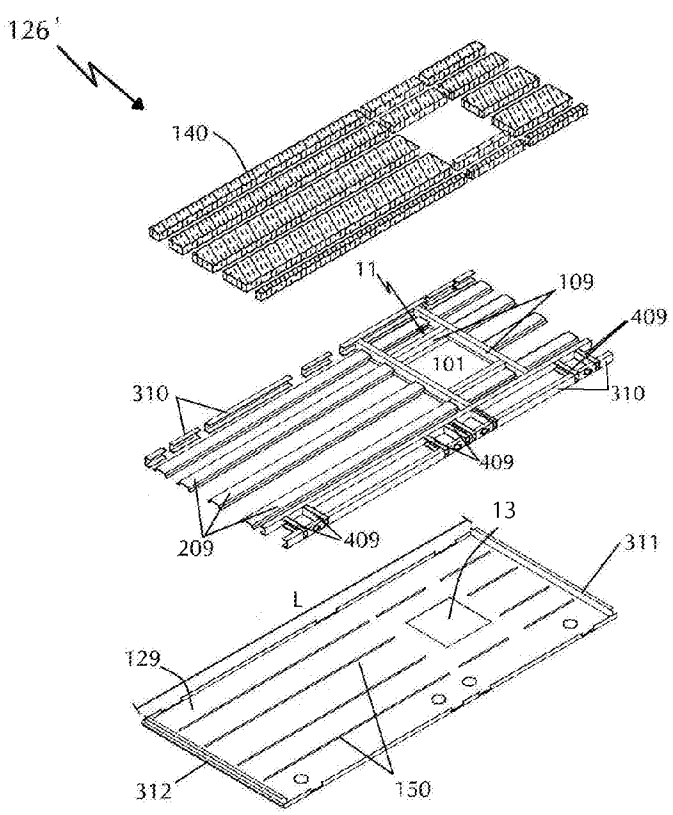
FIG. 2B is a perspective view of the interior portion of another embodiment of the tornado door of the present invention, with the impact side exterior door panel removed, wherein the tornado door does not include an inner door liner.
Figure 2A:
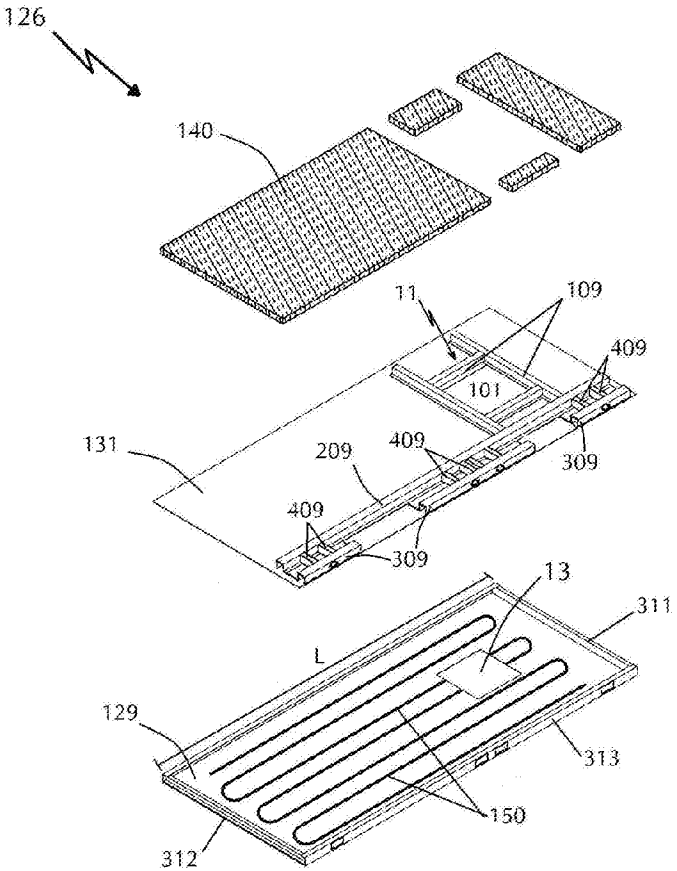
FIG. 2A is an exploded perspective view of the interior portion of an embodiment of the tornado door of the present invention, with the impact side exterior door panel removed, wherein the tornado door includes an inner door liner.

FIG. 2A shows an exploded view of the interior portion of one embodiment of the tornado door of the present invention. As shown in FIG. 2A, in one embodiment, the tornado door comprises an interior portion which includes an inner door skin 129 having an opening 13 therethrough, a plurality of stiffeners 109, 209, 309, 409 bonded to an inner door liner 131, a window assembly 11 wherein a window panel 101 is juxtaposed with the door opening 13, and a polystyrene layer 140 spacing the inner door liner 131 and an outer door skin (not shown). The interior portion of the tornado door includes at least one vertical stiffener 209 extending substantially along the entire length L of the tornado door, a plurality of edge stiffeners 309 along the free edge of door 126, and a plurality of horizontal lock stiffeners 409 interposed between the vertical stiffener 209 and edge stiffeners 309. All of the stiffeners contact the inner door liner 131 and may be secured to the inner door liner by adhesive or welding, for example, resistance or spot welding. The inner door liner 131 may be bonded to the interior surface of door skin 129 with an adhesive such as a two-part epoxy 150 or glue. Side edge channel 313, lower end channel 312 and top end channel 311 are each C-channels which surround the tornado door interior portion and the stiffeners. Channels 311, 312, 313 may be bonded to the front door skin (not shown) and rear door skin 129 by the same type of bonding or welding as the stiffeners.

As shown in FIG. 2A, the window assembly 11 includes a plurality of spacers or stiffeners 109 spacing the inner door liner 131 and the outer door skin (not shown) and positioned about the periphery of a window panel 101, such as an impact resistant glass panel, forming a frame. In an exemplary embodiment, the window panel is a laminated glass panel known as Tor-Gard NBR2™, but may be any high-impact rated, preassembled single or multiple (e.g, two or more) pane unit. For a typical exterior door, the exposed glass within cover ring 119 (discussed further below) is 10"×10", and may range from about 5" to 10" in width and 10" to 35" in height, or about 3% to 6% of the total area of the door. Each stiffener 109 includes a plurality of mounting holes (not shown) for receiving a fastener driven through the outer door skin.

Figure 10:
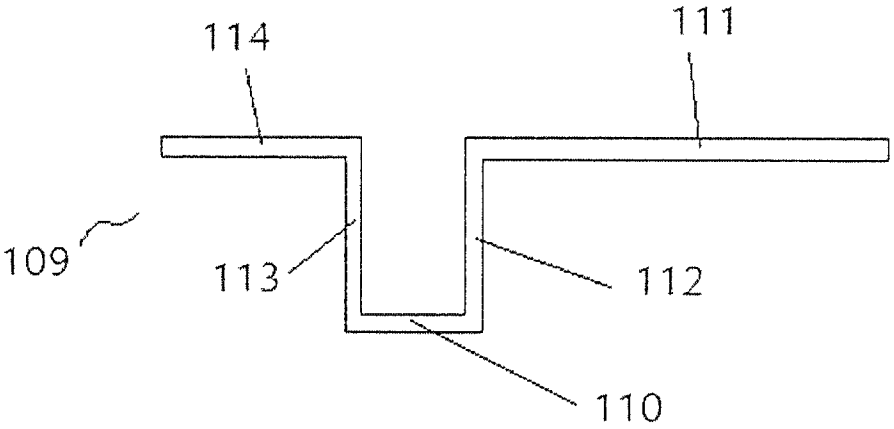
FIG. 10 is a cross-sectional view of one embodiment of a "hat" stiffener of the impact resistant window assembly of the present invention.
Figure 9:
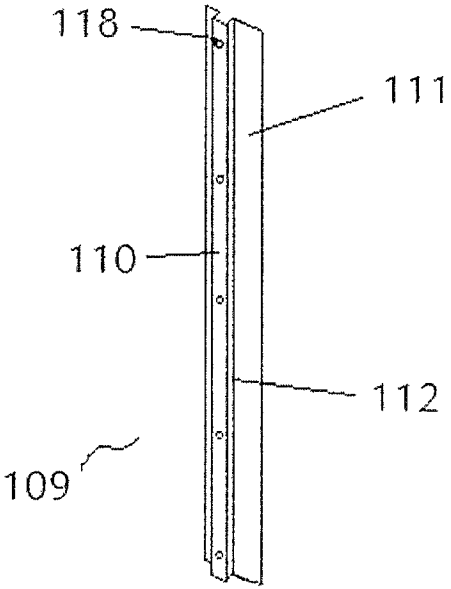
FIG. 9 is a perspective view of one embodiment of a "hat" stiffener of the impact resistant window assembly of the present invention.

One embodiment of a spacer or stiffener 109 is shown in a perspective view (FIG. 9) and a longitudinal cross-sectional view (FIG. 10), respectively. Each stiffener 109 includes at least one leg 112 for mounting perpendicular to the plane of the door panels for spacing the interior sides of the door first and second exterior panels (if the door assembly does not include an inner door liner). If the door includes an inner door liner, leg 112 spaces the inner door liner and the interior side of the door exterior panel. Each stiffener 109 further comprises a receiving flange 111 extending from one end of the first leg 112, and a mounting flange 110 extending from the opposite end of the first leg and including a plurality of mounting holes 118 for receiving fasteners driven through the outer door skin. Both the receiving and mounting flanges 111, 110 are parallel to the door panels. In an exemplary embodiment, the stiffener mounting flange, leg and receiving flange, respectively, form an S-shape. Preferably, mounting flange 110 is positioned such that fasteners driven therethrough will not interfere with the window panel when installing the window assembly in a tornado door (as will be further discussed below). In another embodiment, as shown in FIGS. 9 and 10, each stiffener may further include a second leg 113 parallel to and opposite the first leg 112 having an extending support flange 114 in the same plane as receiving flange 111. Support flange 114 may have a length less than the length of receiving flange 111, or alternatively, the length of the support flange may be equal to or greater than the length of the receiving flange. When viewed in longitudinal cross-section, as in FIG. 10, this alternate embodiment of spacer or stiffener 109 resembles a "hat".

FIG. 2B shows an exploded view of the interior portion of another embodiment of the tornado door of the present invention, wherein the door does not include an inner door liner. As shown in FIG. 2B, the tornado door 126' comprises an interior portion which includes an inner door skin 129 having an opening 13 therethrough, a plurality of stiffeners 109, 209, 409 bonded directly to the interior surface of door skin 129, a window assembly 11 wherein a window panel 101 is juxtaposed with the door opening 13, and a polystyrene layer 140 spacing the door skin 129 and an outer door skin (not shown). The interior portion of the tornado door 126' includes a plurality of vertical stiffeners 209 extending from a lower end channel 312 to the bottom of window assembly 11 and from the top of window assembly 11 to a top end channel 311, respectively, along the length L of the tornado door, a plurality of edge fillers 310 along both side edges of door 126', and a plurality of horizontal lock stiffeners 409 interposed between the vertical stiffener 209 and edge fillers 310 along the free edge of door 126'. All of the stiffeners contact the interior surface of door skin 129 and may be bonded to the interior surface of door skin 129 with an adhesive such as a two-part epoxy 150 or glue. Top end channel 311 and lower end channel 312 are each C-channels which surround the tornado door interior portion and the stiffeners. Channels 311, 312 may be bonded to the front door skin (not shown) and rear door skin 129 by the same type of bonding or welding as the stiffeners.

Figure 3:
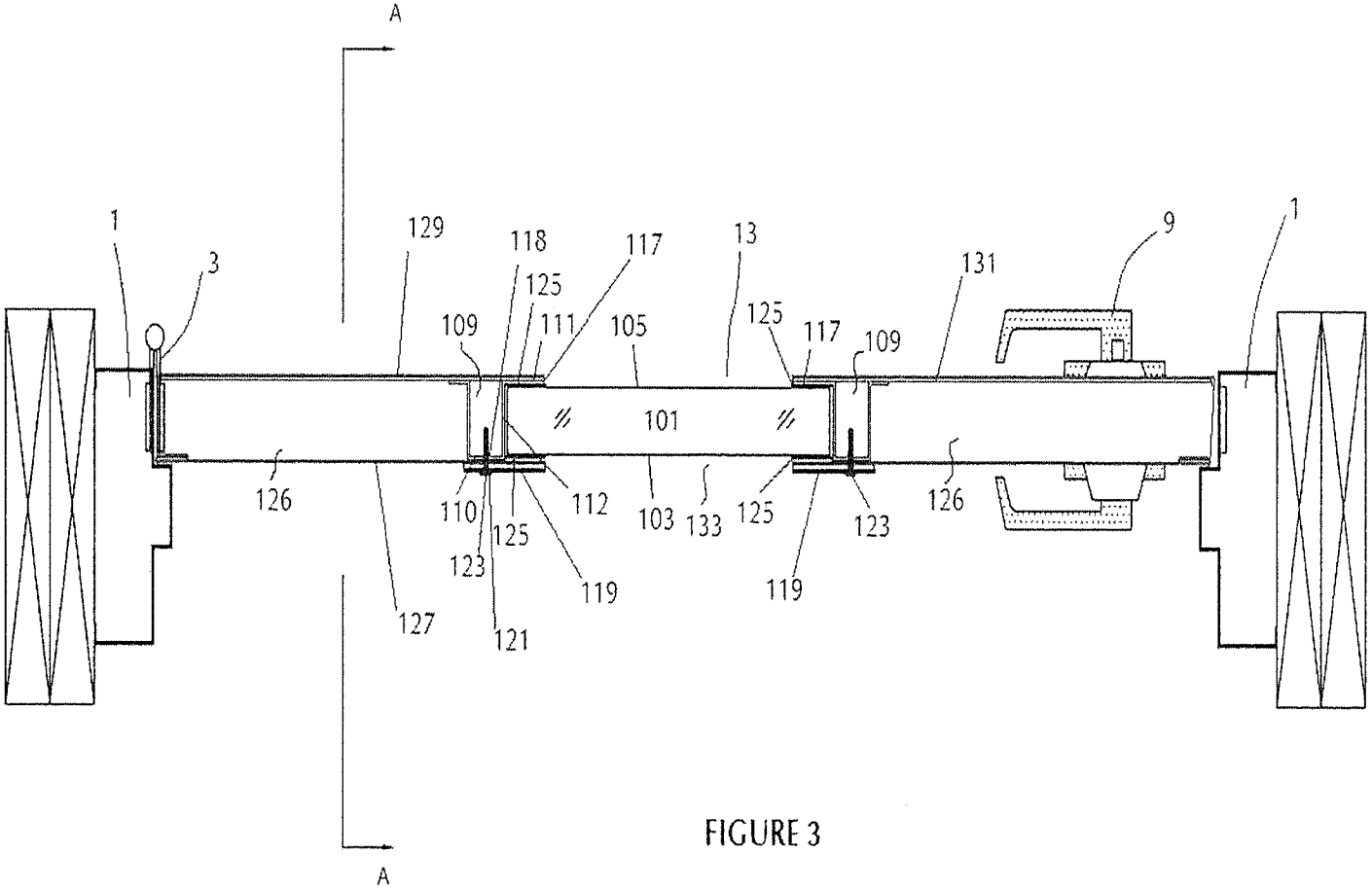
FIG. 3 is a top cross-sectional view of the tornado door of FIGS. 1A and 1B across line A-A.
Figure 4:
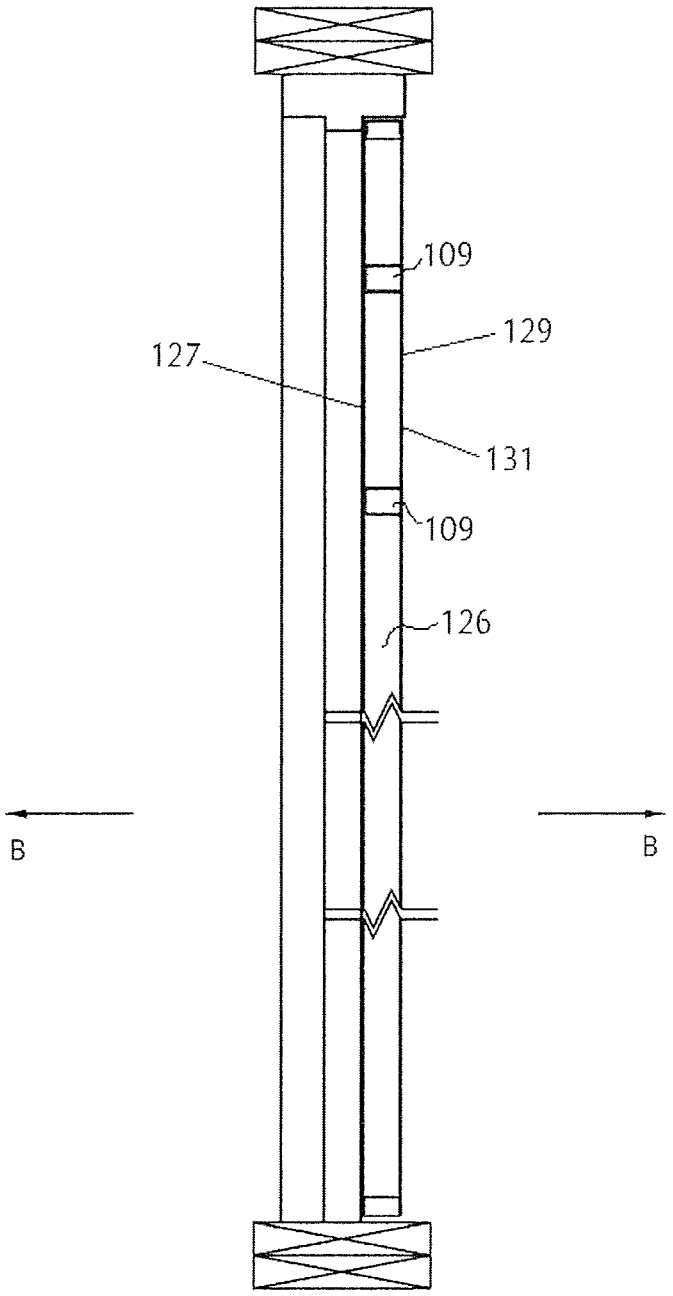
FIG. 4 is a side cross-sectional view of the tornado door of FIGS. 1A and 1B across line B-B.
Figure 8:
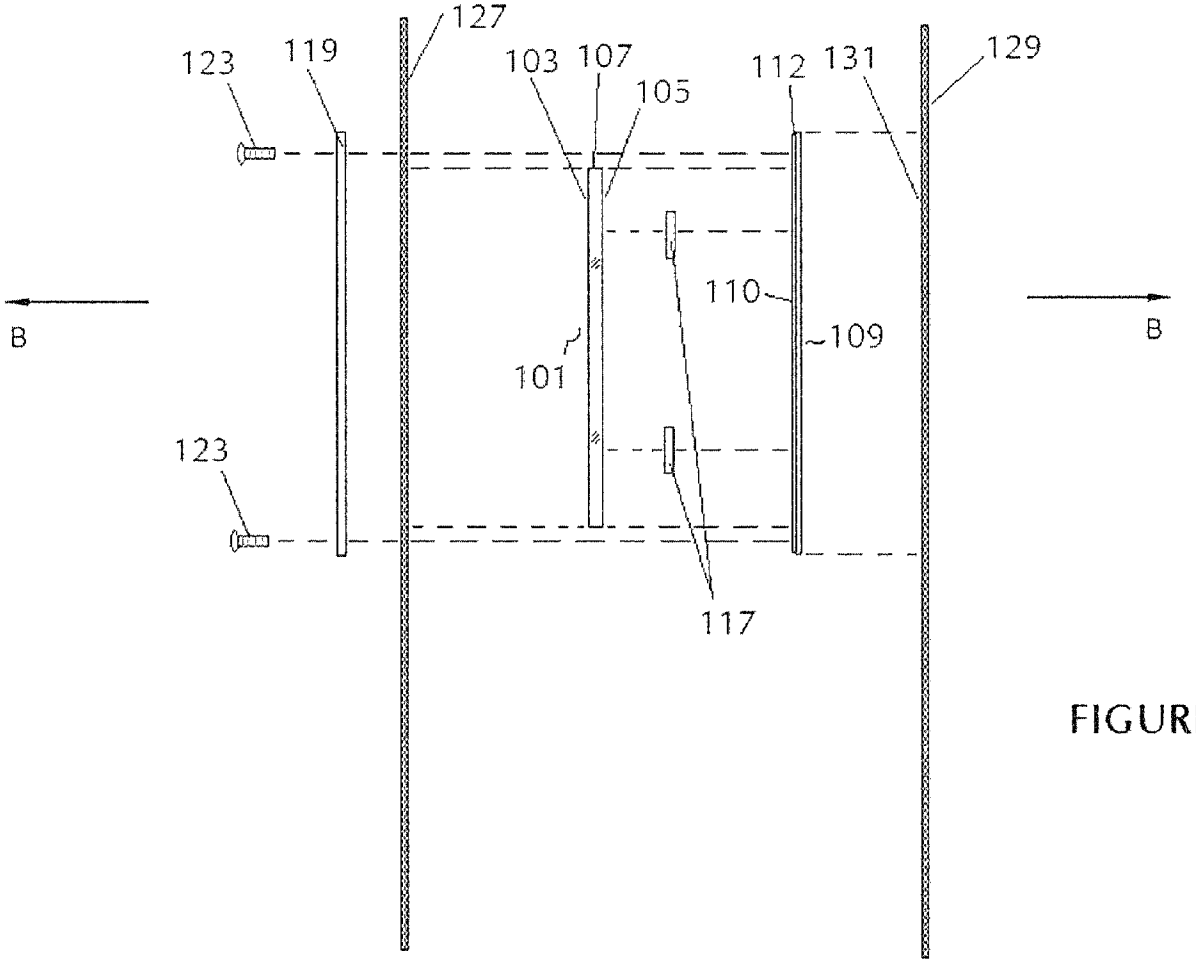
FIG. 8 is an exploded side view of the tornado door of FIGS. 1A and 1B across line B-B.

FIG. 3 depicts a top cross-sectional view of the tornado door of FIGS. 1A and 1B across line A-A, also shown in a side cross-sectional view of FIG. 4 across line B-B and an exploded side view of FIG. 8. As shown in FIG. 3, tornado door 126 includes an inner door liner 131 and "hat" stiffener leg 112 spaces inner door liner 131 and exterior panel or outer door skin 127 and is substantially flush with the periphery of the window panel 101. Stiffener receiving flange 111 contacts the interior surface of inner door liner 131 (or the interior surface of inner door skin 129, if the door does not include an inner door liner) on one face and window panel first surface 105 on the other face, and extends inward toward the center of the window panel until abutting the edge of door opening 13. Receiving flange 111 may be secured to the surface of inner door liner 131 by bonding or other means, as described above. Stiffener mounting flange 110 extends from the opposite end of leg 112 and contacts the interior surface of outer door skin 127. On the exterior surface of outer door skin 127 is a cover ring 119 having an aperture 133 with a width smaller than the width of the window panel, but which allows for visibility when the cover ring is secured to the exterior surface of outer door skin 127. Cover ring 119 is juxtaposed with the "hat" stiffener mounting flanges 110 and includes a plurality of holes 121 for receiving a securing means 123. Fasteners 123, such as ¼"×1" sheet metal screws, pass between the holes 121 in cover ring 119 through the outer door skin 127 and into correspondingly placed mounting holes 118 in the "hat" stiffener mounting flanges 110 to secure the cover ring to the exterior surface of the outer door skin 127. Fasteners 123 do not interfere with window panel 101 when driven through outer door skin 127 and into mounting flanges 110 to secure the window assembly.

Figure 6:
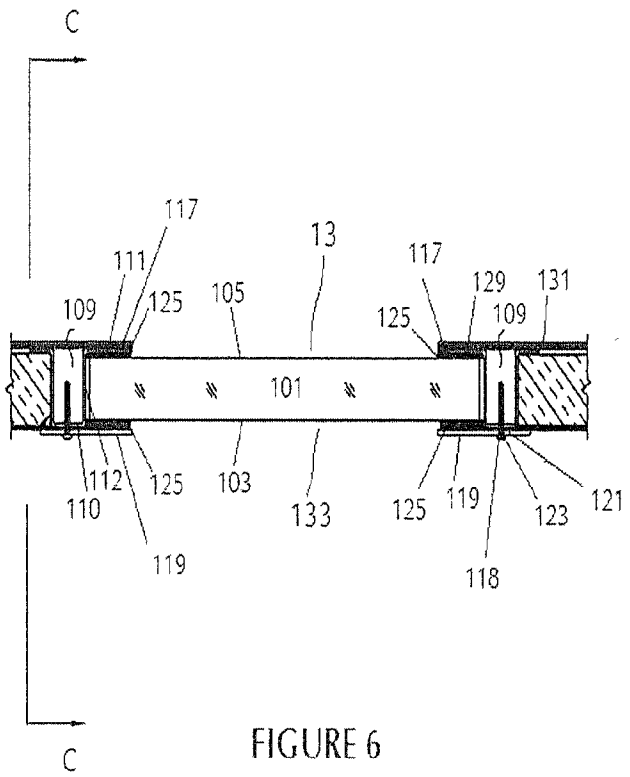
FIG. 6 is a top cross-sectional view of the glazing detail of the impact resistant window assembly of FIG. 5 across line C-C.
Figure 5:
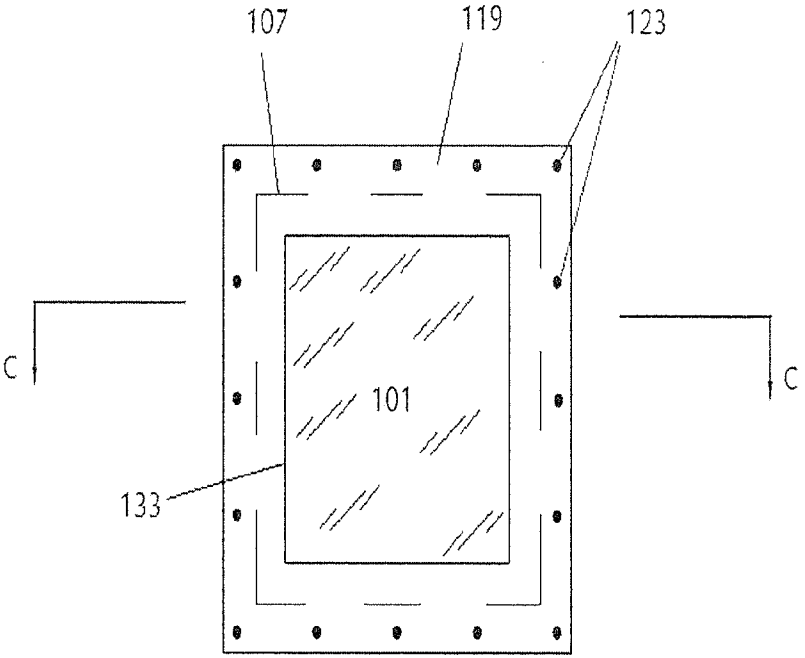
FIG. 5 is a plan view from the impact side of a typical tornado door of the glazing detail of the impact resistant window assembly of the present invention.
Figure 7:
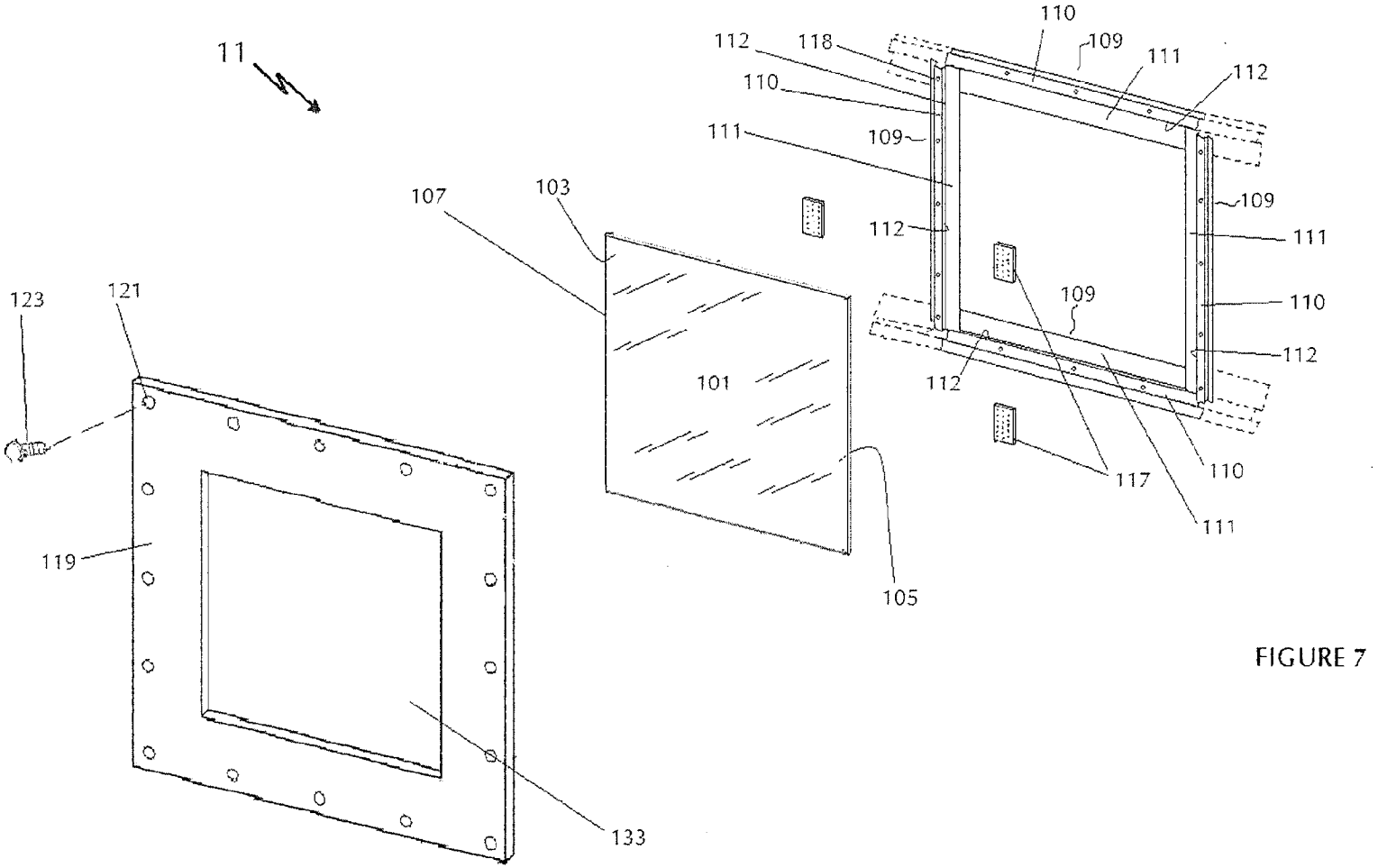
FIG. 7 is an exploded perspective view of the glazing detail of the impact resistant window assembly of FIG. 5.

The glazing detail of one embodiment of the window assembly of the present invention is further depicted in FIGS. 5-7. FIG. 5 shows a window panel 101 positioned behind a cover ring 119, such that the periphery 107 of the window panel extends beyond the aperture 133 of the cover ring but does not interfere with the plurality of fasteners 123 extending through the cover ring mounting holes 121 into the door skin (not shown, for clarity). FIG. 6 shows a top cross-sectional view of FIG. 5 across line C-C. As shown in FIG. 6, a plurality of spacers 117 may be interposed between the "hat" stiffener receiving flanges 111 and the inner surface 105 of the window panel 101 about the periphery of the panel. Receiving flanges 111 extend inward toward the center of the glass panel 101 by a predetermined distance not exceeding the edge of door opening 13 and a sealant 125 is situated at the interface between the receiving flanges 111 and the inner surface 105 of the glass panel 101 about the periphery of the glass panel 101 to establish a firm, weather-tight seal. As further depicted in FIG. 6, sealant 125 may also be applied between the outer surface 103 of glass panel 101 and the interior surface of outer door skin 127 about the periphery of glass panel 101. The sealant is preferably sufficiently flexible to allow some give during pressure and vacuum differentials between opposite sides of the door body, as may occur during certain tornado conditions. The sealant acts in conjunction with the impact-resistant window panel, "hat" stiffeners and door skin to establish an effective barrier and energy absorber against high winds and projectile objects propelled by the winds. In a preferred embodiment, sealant 125 is a silicone sealant, such as Dow Corning™ 955 Adhesive Sealant or any other structural adhesive.

FIG. 7 shows an exploded perspective view of the glazing detail of the impact resistant window assembly of the present invention, not including the inner and outer door skins. As shown in FIG. 7, a plurality of "hat" stiffeners 109 form a frame surrounding the window panel 101, such that the stiffener receiving flanges 111 contact the first surface 105 of the window panel and extend inward toward the center of the panel. Spacers 117 may be interposed between the "hat" stiffener receiving flanges 111 and the inner surface 105 of the window panel 101 about the periphery of the panel. A leg 112 of each "hat" stiffener contacts and is substantially flush with the periphery 107 of the window panel. When assembled, the periphery of the window panel extends beyond the aperture 133 of the cover ring but does not interfere with the plurality of fasteners 123 extending through the cover ring mounting holes 121 into the door skin (not shown, for clarity) and into the stiffener mounting flange receiving holes 118.

The door skins, "hat" stiffeners, edge stiffeners, edge fillers, channels and cover ring may be made from low carbon or other sheet steel. The door skins are typically made of about 16 gauge steel (0.056 in, 1.422 mm). In the space between the interior and exterior panels, a plurality of vertical structural stiffeners may be bonded to a liner panel, located on the interior side of the door. The vertical structural stiffeners are typically made of about 22 gauge steel (0.029 in, 0.74 mm), as is the liner panel.

Although the liner panel may be of a different thickness, it should provide sufficient structural integrity to maintain its shape and form in an upright position prior to bonding to the stiffeners. Typical door skin thickness may be in the range of about 0.035 to 0.104 inches (0.89 mm to 2.64 mm). Liner thickness is typically in the range of about 0.029 to 0.250 inches (0.74 to 2.54 mm), and is at least 0.029 inches (0.074 mm). Top and bottom horizontal stiffeners may also be included at the top and bottom of the liner panel and are typically more rigid than the vertical stiffeners.

An advantage of the present invention is the ability of the impact resistant window assembly to withstand the impact conditions associated with tornado-induced flying debris. Significantly, the door of the present invention is constructed to successfully pass the current FEMA 320 and 361 door lite assembly criteria for testing. More specifically, the door of the present invention is constructed to meet testing requirements including a direct impact of a 15 lb. 2×4 board "missile" traveling at 100 mph striking the exterior surface of a door with a door lite. During impact testing, the tornado door skins are subject to impact from a 15 lb "missile" of varying length at a muzzle distance of approximately 21 ft. from the door, at various points of impact. Points of impact include adjacent the hinged edge of the door, on the free edge of the door adjacent the locking mechanism, and direct impact on the center of the window panel. Upon impact, the window assembly of the present invention has been shown to remain intact in the tornado door with no ejection of debris into the interior of the tornado shelter or safe room and door deflection within acceptable limits pursuant to ICC 500-2008 [International Code Council® (ICC®) ICC/NSSA Standard for the Design and Construction of Storm Shelters] and FEMA 320.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An impact resistant window assembly for a tornado door, comprising:

a window panel sized to be oriented within an opening in a door having spaced first and second exterior panels, the window panel having opposite first and second surfaces and an edge defining a periphery;

a plurality of S-shaped stiffeners positioned about the periphery of the window panel forming a frame, the plurality of S-shaped stiffeners adapted to space interior sides of the door first and second exterior panels and defining a plurality of mounting holes;

a cover ring having an aperture and defining a plurality of mounting holes, the cover ring for placement on an exterior surface of one of the door first or second exterior panels and juxtaposed with the plurality of S-shaped stiffeners, the cover ring and plurality of S-shaped stiffeners intersecured using a plurality of fasteners which pass between the cover ring mounting holes for passing through the door first or second exterior panel and into the S-shaped stiffener mounting holes; and a sealant establishing a seal between the window panel and the plurality of S-shaped stiffeners and for placement between the window panel and the door first or second exterior panel.

2. The window assembly of claim 1 wherein the window panel, S-shaped stiffeners, cover ring and sealant establish a structure capable of withstanding the impact conditions associated with tornado-induced flying debris as measured by successful passing of FEMA testing standard FEMA 320 and 361 based on direct impact of a 15 lb. 2×4 board missile traveling at 100 miles per hour.

3. The window assembly of claim 1 wherein each of the S-shaped stiffeners has a first leg contacting the periphery of the window panel and adapted to space interior sides of the door first and second exterior panels, a receiving flange extending from an end of the first leg facing the window panel first surface and extending inward toward the center of the window panel by a predetermined distance, and a mounting flange extending from an opposite end of the first leg, the mounting flange including the stiffener plurality of mounting holes.

4. The window assembly of claim 3 further comprising a plurality of spacers transposed between the window panel first surface and the stiffener receiving flanges about the periphery of the window panel.

5. The window assembly of claim 3 wherein each of the stiffeners has a second leg opposite the first leg and adapted to space interior sides of the door first and second exterior panels, the second leg including a support flange in the same plane as the stiffener receiving flange.

6. The window assembly of claim 1 wherein the door includes an inner door liner and the plurality of S-shaped stiffeners are bonded to the inner door liner.

7. The window assembly of claim 1 wherein the window panel is a laminated glass panel.

8. The window assembly of claim 1 wherein the sealant is a silicone structural adhesive.

9. The window assembly of claim 1 wherein the fasteners are sheet metal screws.

10. A tornado door comprising:

a door body having spaced first and second exterior panels and an opening therethrough, the door body further having a length;

a window panel sized to be oriented within the door body opening, the window panel having opposite first and second surfaces and an edge defining a periphery;

a plurality of S-shaped stiffeners positioned about the periphery of the window panel forming a frame, the plurality of S-shaped stiffeners spacing the interior sides of the door body first and second exterior panels and defining a plurality of mounting holes;

a cover ring having an aperture and defining a plurality of mounting holes, the cover ring positioned on an exterior surface of one of the door body first or second exterior panels and juxtaposed with the plurality of S-shaped stiffeners, the cover ring and plurality of S-shaped stiffeners intersecured using a plurality of fasteners which pass between the cover ring mounting holes through the door body first or second exterior panel and into the stiffener mounting holes; and a sealant establishing a seal between the window panel and the plurality of S-shaped stiffeners and between the window panel and the door body first or second exterior panel.

11. The tornado door of claim 10 wherein the window panel, S-shaped stiffeners, cover ring and sealant establish a structure capable of withstanding the impact conditions associated with tornado-induced flying debris as measured by successful passing of FEMA testing standard FEMA 320 and 361 based on direct impact of a 15 lb. 2×4 board missile traveling at 100 miles per hour.

12. The tornado door of claim 10 wherein the door body first and second exterior panels are comprised of gauge steel.

13. The tornado door of claim 10 further comprising a polystyrene layer between the door body first and second exterior panels.

14. The tornado door of claim 13 wherein S-shaped stiffeners are positioned horizontally above and below the window panel, and further comprising a plurality of structural stiffeners extending vertically within substantially the entire length of the door body above and below the S-shaped stiffeners and window panel and spacing the door body first and second exterior panels.

15. The tornado door of claim 13 further comprising an inner door liner and wherein the plurality of S-shaped stiffeners are bonded to the inner door liner.

16. The tornado door of claim 10 wherein each of the S-shaped stiffeners has a first leg contacting the periphery of the window panel and spacing the interior sides of the door first and second exterior panels, a receiving flange extending from an end of the first leg facing the window panel first surface and extending inward toward the center of the window panel by a predetermined distance, and a mounting flange extending from an opposite end of the first leg, the mounting flange including the stiffener plurality of mounting holes.

17. The tornado door of claim 16 further comprising a plurality of spacers transposed between the window panel first surface and the stiffener receiving flanges about the periphery of the window panel.

18. The window assembly of claim 16 wherein each of the S-shaped stiffeners has a second leg opposite the first leg and spacing the interior sides of the door first and second exterior panels, the second leg including a support flange in the same plane as the stiffener receiving flange.

19. The tornado door of claim 10 wherein the window panel is a laminated glass panel.

20. The tornado door of claim 10 wherein the sealant is a silicone structural adhesive.

21. The tornado door of claim 10 wherein the fasteners are sheet metal screws.

22. A method of using a tornado door comprising:

providing the tornado door of claim 10;

exposing the tornado door to impact conditions associated with tornado-induced flying debris;

causing the door to bow toward a non-impact side of the door as a result of impact at an impact side of the door; and using the door body, S-shaped stiffeners, cover ring and sealant, maintaining the window panel in a secured position between the interior side of the door body first or second exterior panel and the plurality of S-shaped stiffeners as the door bows.

23. The method of claim 22 wherein the impact conditions associated with tornado-induced flying debris are measured by FEMA testing standard FEMA 320 and 361.

* * * * *